United States Patent [19]

Kazama et al.

[11] Patent Number: 4,833,055

[45] Date of Patent: May 23, 1989

[54] ELECTROPHOTOGRAPHIC PHOTORECEPTOR COMPRISING AMORPHOUS SILICON AND AMORPHOUS CARBON BUFFER LAYER

[75] Inventors: Toyoki Kazama; Koichi Aizawa; Kenichi Hara; Toshiyuki Iijima; Yukio Takano, all of Kawagawa, Japan

[73] Assignee: Fuji Electric Co., Ltd., Kanagawa, Japan

[21] Appl. No.: 58,245

[22] Filed: Jun. 4, 1987

[30] Foreign Application Priority Data

Jun. 13, 1986 [JP] Japan ..... 61-137531

[51] Int. Cl.[4] ..... G03G 5/14

[52] U.S. Cl. ..... 430/66; 430/67; 430/128; 430/132

[58] Field of Search ..... 430/66, 67, 128, 132

[56] References Cited

U.S. PATENT DOCUMENTS 4,675,265 6/1987 Kazama et al. ..... 430/65

*Primary Examiner*—J. David Welsh

*Attorney, Agent, or Firm*—Finnegan, Henderson, Farabow, Garrett, & Dunner

[57] ABSTRACT

An electrophotographic photoreceptor comprises a conductive base, a photoconductive layer formed of amophous silicon on the conductive base, a buffer layer on the photoconductive layer, and a surface layer covering the photoconductive layer through the buffer layer, wherein the buffer layer is formed of amorphous carbon.

6 Claims, 2 Drawing Sheets

ELECTROPHOTOGRAPHIC PHOTORECEPTOR COMPRISING AMORPHOUS SILICON AND AMORPHOUS CARBON BUFFER LAYER

BACKGROUND OF THE INVENTION

The present invention relates to an electrophotographic photoreceptor with a photoconductive layer formed of amorphous silicon (a-Si).

Conventionally, a photoreceptor employing amorphous Se or amorphous Se doped with impurities such as As, Te and Sb, or ZnO or CdS dispersed in the resin binder is in use as an electrophotographic photoreceptor. However, those photoreceptors still present some problems in view of heat resistance, environmental pollution and mechanical strength.

There has recently been proposed the art of remedying the drawbacks of the conventional electrophotographic photoreceptor by using amorphous silicon for the photoconductive layer. The a-Si prepared through vapor deposition or sputtering is undesirable for use in such an electrophotographic photoreceptor because its dark resistivity is as low as $10^5$ Ωcm while its photoconductivity is extremely small. In such a-Si, there are formed the so-called dangling bonds with the severed Si-Si bonds and, due to the defect, a number of localized states are present in the energy gap. For this reason, the hopping conduction of the thermally excited carriers occurs and causes the dark resistivity to reduce and further, because the photo generated carriers are trapped by the localized states, the photoconductivity is badly affected.

On the other hand, the aforesaid defect is trapped by hydrogen atoms (H) and Si is thereby bonded to H in hydrogenated amorphos silicon (a-Si(H)) prepared through the glow discharge decomposition of silane gas ($SiH_4$) or photo CVD, whereby the photoconductivity is improved and p- and n-type valence electron control can readily be conducted because of the far reduced number of dangling bonds. Notwithstanding, its dark resistivity is within the range of $10^8$–$10^9$ Ωcm, which is still lower than $10^{12}$ Ωcm being deemed satisfactory for the photographic photoreceptor. The photoreceptor thus formed of a-Si(H) consequently provides the high dark decay rate of the surface potential and low initial charged potential. However, the resistivity may be increased up to over $10^{12}$ Ωcm to provide high charge acceptance by doping the a-Si(H) with a proper amount of boron so that it may be applicable to the copying process of the Carlson method.

The photoreceptor with the a-Si(H) as a surface layer allows the acquisition of good images initially but apparently produces not only images of inferior quality very often after it is exposed to the air or stored in a humid environment for a long period of time but also those having a blur gradually after it undergoes a copying process a number of times. Such a degraded photoreceptor tends to produce the blur particularly in a humid environment and, as the number of copying times increases, it has been confirmed that the critical humidity at which the image begins to blur also tends to lower.

As aforementioned, because of the exposure to the air and humidity for a long time, or because of chemical species (ozone, nitrogen oxide, nascent oxygen, etc.) generated by the corona discharge during the copying process, it is considered that the surface of the photoreceptor is easily affected thereby and the change of chemical properties produces inferior images. However, the mechanism of such surface deterioration has not yet been fully examined and attempts have been made to prevent the production of such inferior images and improve printing durability by providing a protective layer on the surface of the a-Si(H) photoreceptor to stabilize its chemical properties. For instance, there is a known method of preventing the surface layer of a photoreceptor from deteriorating because of the copying process or environmental atmosphere by employing hydrogenated amorphous silicon carbide (a-$Si_xC_{1-x}$(H), $0<x<1$) or hydrogenated amorphous silicon nitride (a-$Si_xN_{1-x}$(H), $0<x<1$) for the surface protective layer (Japanese Patent Laid Open No. 115559/82).

Although the printing durability is improvable provided the carbon or nitrogen concentration in the surface protective layer is properly selected, a buffer layer must be provided to moderate the material heterogeneity between the a-Si(H) and a-$Si_{1-x}C_x$(H), a-$Si_{1-x}N_x$(H). As it is preferred to gradually change the bond length and the energy gap in the buffer layer, the mixture ratio of a gas containing Si to what contains C or N has gradually been changed for the purpose. However, the aforesaid process is unfavorably complicated.

As a known buffer layer between the photoconductive layer of amorphous silicon and the surface layer of amorphous carbon, there are a-$Si_{1-x}C_x$(H) ($0<x<1$) and a-$Si_{1-x}C_x$(H, F) ($0<x<1$) (Japanese Patent Application No. 61164/85). Since a mixed gas containing silicon (e.g., $SiH_4$, $Si_2H_6$,$SiF_4$, etc.) and carbon (e.g., $CH_4$, $C_2H_6$, $C_2H_4$, $C_2H_2$, $C_6H_6$, etc.) is employed to form such a buffer layer as raw materials, the process becomes complicated and a number of checking items are required to realize the value x. In other words, a single kind of gas should preferably be used.

SUMMARY OF THE INVENTION

The present invention is based on the finding that a layer equivalent in function to the buffer layer can be formed by changing the conditions while employing one kind of hydrocarbon gas.

An object of the present invention is to provide an a-Si photoreceptor free from deterioration against not only storage for a long period of time but also repetitive use so that print defects are scarcely produced even in the atmosphere of high humidity; more specifically, an a-Si photoreceptor whose properties are stable at all times and not restricted by environmental conditions for use but excellent in durability, and humidity resistance.

The photoreceptor according to the present invention has a photoconductive layer prepared from amorphous silicon (a-Si) and laminated on a conductive base; and a surface layer prepared from a-$Si_{1-x}C_x$(H), a-$Si_{1-x}N_x$(H), preferably a-C(H), the surface layer covering the photoconductive layer over a buffer layer. In this case, it is particularly preferred to make the energy gap in the surface layer increase from the photoconductive layer side toward the surface side.

The a-Si photoconductive layer should be prepared from at least one of the hydrogenated amorphous silicon (a-Si(H)), hydrogenated fluorinated amorphous silicon (a-Si(F,H)), hydrogenated amorphous silicon carbide (a-$Si_{1-x}C_x$(H))($0<x<1$), hydrogenated fluorinated amorphous silicon carbide (a-$Si_{1-x}C_x$(F, H)) ($0<x<1$), hydrogenated amorphous silicon nitride (a-$SiN_x$(H)) ($0<x<4/3$) and hydrogenated fluorinated amorphous silicon oxide (a-$SiO_x$(F, H))($0<x<2$) or otherwise the layer doped with them.

Moreover, the amorphous carbon is such that the carbon dangling bonds have been stabilized by hydrogen and are expressed by a-C(H). The word means that basically its diffraction image by means of X-rays or electron beams is unclear and, even though part of it contains a crystalline portion, that percentage is low. Hydrogen is combined with carbon and absorption exists at least close to 2,900 $cm^{-1}$. As a means for stabilizing the carbon dangling bond, it is also effective to have fluorine, oxygen and nitrogen other than hydrogen contained therein.

The properties of amorphous carbon can be controlled in a wide range by changing the manufacturing conditions including the flow rate, gas pressure, RF power, base temperatures, etc. FIG. 3 shows the relation between the gas pressure and the energy gap when 100% $C_2H_4$ gas is used. It is possible to control the energy gap within the range of 1.5 eV–3.0 eV. Other manufacturing conditions include RF power at 200 W, base temperature at 100° C., etc. The present applicants have also discovered that, when the kind of gas, RF power and base temperature are changed, the absolute value of the energy gap slightly varies but it is greatly affected by the film forming gas pressure. In consequence, a surface layer can now be formed by changing manufacturing conditions, particularly the gas pressure to control the energy gap in the surface layer from the photoconductive layer to the surface of the photoreceptor while preventing the material mismatching of the photoconductive and surface layers.

DETAILED DESCRIPTION OF THE INVENTION

Figure 1:
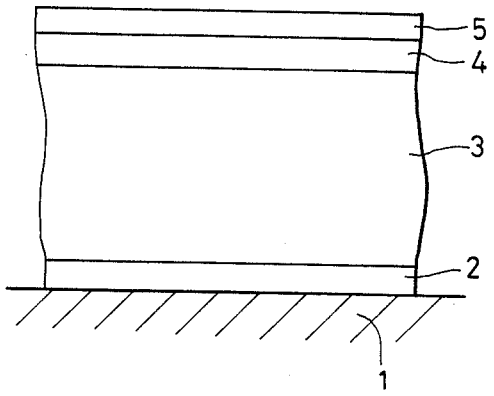
FIG. 1 is a sectional structural view of a layer embodying the present invention.
Figure 3:
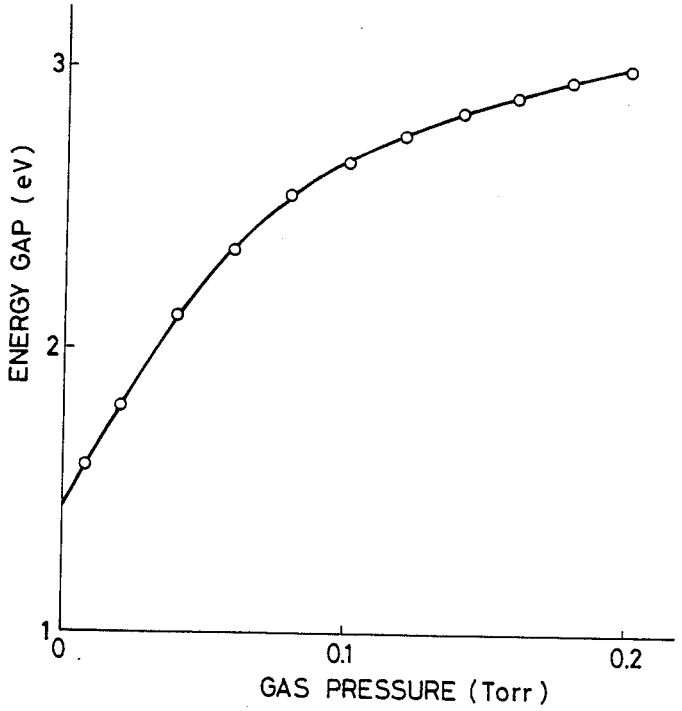
FIG. 3 is a graph showing the relation between an a-C(H) gas pressure and an energy gap in the present invention.

FIG. 1 shows the structure of a photoreceptor embodying the present invention, the photoreceptor having a laminate comprising a blocking layer 2 on a conductive base 1 of Al, stainless steel or the like, an a-Si photoconductive layer 3, an a-C(H) buffer layer 4 and an a-C(H) or a-C(O, H) surface layer 5. The conductive base 1 may be in the form of either cylinder or sheet and, in view of material, composed of either glass or resin coated with conductive material.

The object of the provision of the blocking layer 2 is to prevent a charge from being injected from the conductive base 1. The blocking layer can be made of $Al_2O_3$, AlN, SiO, $SiO_2$, a-$Si_{1-x}C_x$(F, H), A-$SiN_x$(H)a-C(H) and a-C(F); and a-C(H), a-C(F) and a-Si(H) doped with elements of III or V group.

EXAMPLE 1

A photoreceptor having the structure shown in FIG. 1 was formed as follows: An apparatus shown in FIG. 2 comprises a holder 12 for the base 1 contained in a vacuum tank 11, electrodes 13 installed opposite to the holder 12 and heaters 14, 15 respectively fitted to the holder 12 and the electrodes 13. The cylindrical base 1 of Al degreased and rinsed with trichloroethylene was fixed to the holder 12 and the tank was evacuated by means of a vacuum pump 16 through a exhaust valve 17 so that the pressure inside the tank 11 was set at $10^{-6}$ Torr. The holder 12 heated by the heaters 14, 15 to keep the base temperature at a predetermined level and the conductive base 1 were rotated to provide film uniformity in the circumferential direction.

Subsequently, gas pressure container valves 18 of material gas pressure containers 21–25 required for the formation of a film were opened and then stop valves 20 were opened to supply the gas to the vacuum tank 11 via flowmeters 19. The same procedure was followed as for other kinds of gas. The pressure in the tank was adjusted to, e.g., 0.001–5 Torr and then high-frequency power (13.56 MHz) was supplied from a high-frequency (RF) power supply 31 to the opposite electrodes 13 through an insulating material 32. Glow discharge was caused between the electrodes 13 and the base 1, whereby a blocking layer 2 of 0.2 μm thick was formed.

| | |
|---|---|
| $SiH_4$ (100%) flow rate | 250 cc/min |
| $B_2H_6$ (5000 ppm, $H_2$ base ) flow rate | 20 cc/min |
| Gas pressure | 0.5 Torr |
| RF power | 50 W |
| Base temperature | 200° C. |
| Film forming time | 10 min |

Figure 2:
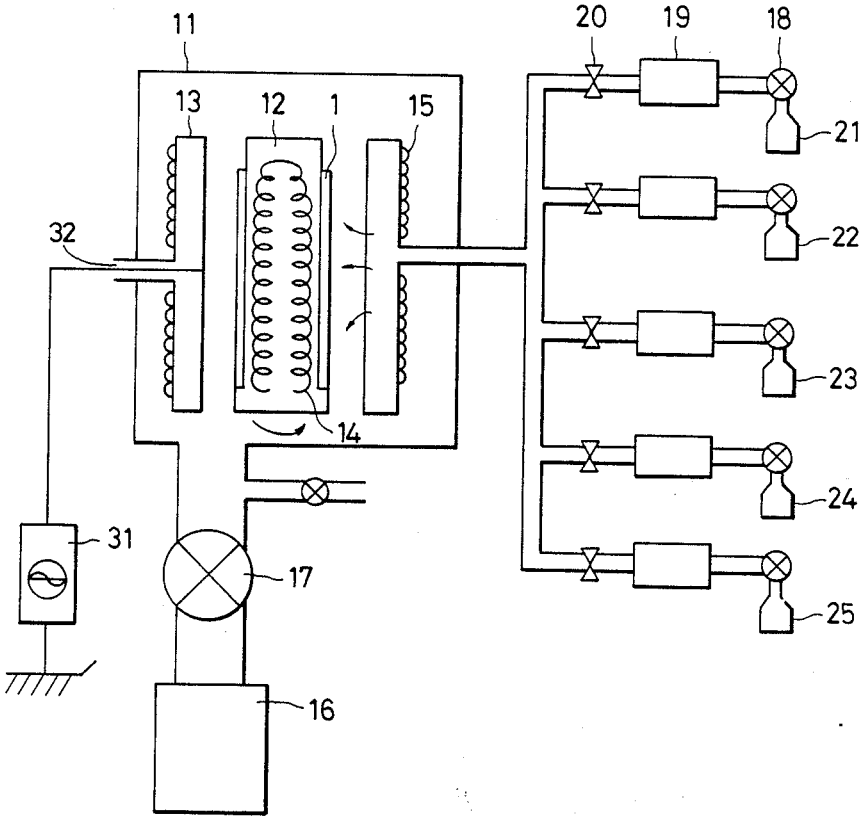
FIG. 2 is a structural block diagram of an apparatus for use in the present invention.

In addition, the apparatus shown in FIG. 2 was used to form a photoconductive layer 3 of 25 μm thick using $SiH_4$, $B_2H_6$ as material gas under the following conditions:

| | |
|---|---|
| $SiH_4$ (100%) flow rate | 200 cc/min |
| $B_2H_6$ (20 ppm, $H_2$ base ) flow rate | 10 cc/min |
| Gas pressure | 1.2 Torr |
| RF power | 300 W |
| Film forming time | 3 hrs |

Further, an a-C(H) buffer layer 4 and a surface layer 5 of 0.5 μm were formed under the following conditions:

| | Buffer layer 4 | Surface layer 5 |
|---|---|---|
| $C_2H_4$ (100%) flow rate | 20 cc/min | 40 cc/min |
| Gas pressure | 0.04 Torr | 0.08 Torr |
| RF power | 200 W | 200 W |
| Base temperature | 100° C. | 100° C. |
| Film forming time | 5 min | 30 min |

A thermocouple and a infrared thermometer were used to measure the base temperature. The photoreceptor thus prepared is hereinafter called a specimen 1. The energy gap of the photoconductive layer of the specimen 1 was 1.8 eV, whereas the energy gaps of the buffer layer and surface layer were 2.1 eV and 2.4 eV, respectively. The specimen 1 was set in a Carlson type plain paper copier and 100,000 sheets of copies were taken. Extremely clear images were obtained. Moreover, the images obtained at 35° C. and 85% relative humidity were also clear.

For comparison, a photoreceptor without the buffer layer 4 was prepared in the same procedure as in the case of the specimen 1 and copy testing was carried out. Image resolution was reduced at 35° C. and 60% relative humidity and blur was produced in images. As is obvious from the comparison, the formation of the buffer layer contributes to improving the matching of the photoconductive layer 3 and the surface layer 5.

It is not always necessary to employ $C_2H_4$ for the formation of the buffer and surface layers and various kinds of hydrocarbon gases, e.g., $CH_4$,$C_2H_6$, $C_3H_8$, $C_4H_{10}$, $C_2H_2$, $C_6H_6$, and mixtures of those gases and hydrogen or oxygen gas may be used. The base temperature in the formation of the surface layer should preferably be within the range of 50°–150° C. and the energy required for gas decomposition per unit quantity of gas should preferably be 300–20,000 J/cc. The gas pressure should preferably be 0.001–0.5 Torr. The application of bias voltage from the outside is effective in controlling the film quality and besides the bias is naturally generated in the case of Rf discharge. This is normally called a self-bias and a suitable bias voltage should be within the range of $+100 \sim +500$ V, $-100 \sim -1500$ V.

There is no problem as to printing durability even if a-$Si_{1-x}C_x$(H) or a-$Si_{1-x}N_x$(H) other than amorphous carbon is used for the surface layer 5.

According to the present invention, the surface layer of the electrophotographic photoreceptor having the a-Si photosensitive layer is made of a-$Si_{1-x}C_x$(H) or a-$Si_{1-x}N_x$(H) or more preferably a-C(H) and moreover the buffer layer is also made of the a-C(H), so that the photoreceptor having not only required electric properties but also excellent printability and humidity resistance can be manufactured under a simplified process.

What is claimed is:

1. An electrophotographic photoreceptor, comprising:

a conductive base;

a photoconductive layer formed of amorphous silicon over said conductive base;

a buffer layer on said photoconductive layer; and a surface layer on said buffer layer covering said photoconductive layer over said buffer layer wherein said buffer layer consists essentially of amorphous carbon.

2. An electrophotographic photoreceptor as claimed in claim 1, wherein said surface layer includes amorphous carbon.

3. An electrophotographic photoreceptor as claimed in claim 1, further comprising a blocking layer between said conductive base and said photoconductive layer.

4. A method of manufacturing an electrophotographic photoreceptor, comprising the steps of:

forming a photoconductive layer of amorphous silicon photoconductive layer over a conductive base;

subjecting the photoconductive layer to a material gas for forming an amorphous carbon buffer layer; and subjecting the buffer layer to a gas having the same material as the buffer layer forming a surface layer on said buffer layer.

5. A method according to claim 4 including the step of forming a blocking layer between said conductive base and said photoconductive layer.

6. A method according to claim 4 wherein said material gas is a mixture of gas selected from the group consisting of $C_2H_2$, $CH_4$, $C_2H_6$, $C_3H_8$, $C_2H_2$ with one of hydrogen or oxygen gas.

* * * * *